United States Patent [19]

Kuse

[11] Patent Number: 4,546,068

[45] Date of Patent: Oct. 8, 1985

[54] METHOD FOR PROCESSING OF LIGHT-SENSITIVE SILVER HALIDE COLOR PHOTOGRAPHIC MATERIAL

[75] Inventor: Satoru Kuse, Hino, Japan

[73] Assignee: Konishiroku Photo Industry Co., Ltd., Tokyo, Japan

[21] Appl. No.: 614,971

[22] Filed: May 29, 1984

[30] Foreign Application Priority Data

| | | | |
|---|---|---|---|
| Jun. 9, 1983 | [JP] | Japan | 58-103839 |
| Jul. 30, 1983 | [JP] | Japan | 58-140272 |
| Mar. 30, 1984 | [JP] | Japan | 59-64378 |

[51] Int. Cl.[4] ..... G03C 7/30

[52] U.S. Cl. ..... 430/375; 430/380; 430/447; 430/467; 430/468; 430/469; 430/490; 430/491

[58] Field of Search ..... 430/380, 375, 393, 467, 430/468, 469, 491, 490

[56] References Cited

U.S. PATENT DOCUMENTS

| | | | |
|---|---|---|---|
| 3,839,045 | 10/1974 | Brown | 430/467 |
| 3,994,730 | 11/1976 | Frank et al. | 430/467 |
| 4,057,427 | 11/1977 | Enriquez | 430/379 |
| 4,174,968 | 11/1979 | Frank | 430/375 |
| 4,264,716 | 4/1981 | Vincent et al. | 430/467 |
| 4,277,556 | 7/1981 | Koboshi et al. | 430/943 |
| 4,330,616 | 5/1982 | Kurematsu et al. | 430/376 |
| 4,348,475 | 9/1982 | Wernicke et al. | 430/467 |
| 4,482,626 | 11/1984 | Twist et al. | 430/467 |

*Primary Examiner*—Mary F. Downey

*Attorney, Agent, or Firm*—Frishauf, Holtz, Goodman & Woodward

[57] ABSTRACT

There is disclosed a method for processing of a light sensitive silver halide color photographic material characterized by carrying out, after an image exposure of the material, a development processing of the material in the presence of the following components (A), (B), and (C) and/or (D):

(A) an aromatic primary amine color developing agent compound;

(B) a manganese salt and/or a cerium salt;

(C) a diphosphonic acid sequestering agent and a magnesium salt and/or a lithium salt; and (D) at least one of the sequestering agent selected from the group consisting of the compounds represented by the formulas (I), (II), (III), (IV) and (V) found in the specification.

15 Claims, No Drawings

METHOD FOR PROCESSING OF LIGHT-SENSITIVE SILVER HALIDE COLOR PHOTOGRAPHIC MATERIAL

BACKGROUND OF THE INVENTION

This invention relates to a method for processing of a light-sensitive silver halide color photographic material, more particularly to a method for processing of the light-sensitive silver halide color photographic material by the use of a stable color developing solution having an improved preservability.

Generally, a light-sensitive silver halide color photographic material is, after an imagewise exposure, subjected to a series of photographic processings which include a color developing process and a desilvering process as fundamental processes, in order to form a color image.

In the aforesaid color developing process, an oxidant of the color developing agent brings about a coupling reaction with a coexisting color coupler, whereby the color image of an image pattern is formed and a reduced silver is simultaneously produced. The thus produced reduced silver will be oxidized with a bleaching agent in the successive desilvering process and be further treated with a fixing agent in order to be converted into a soluble silver complex, and the latter will be then dissolved off by washing.

In an actual development processing step, besides the fundamental processes for the purpose of the above-mentioned color development and desilvering, there are utilized auxiliary processing baths such as a stop bath, a hardening bath, a stabilizing bath and a packing removal processing bath with the intention of improving photographic or physical properties of an image.

On the other hand, in a usual color developing solution, a sulfite or the combination of a water-soluble salt of the sulfite and hydroxylamine is addedly included as a preservative for the sake of preventing the oxidization of an aromatic primary amine color developing agent.

As already known, when the sulfite is alone added to the developing solution, its preservative effect will not be always sufficient, therefore the hydroxylamine is added thereto in the form of a water-soluble salt so as to provide it with a more effective preservative character. Further, as the preservatives which can be employed in place of the sulfite and the hydroxylamine above, dihydroxyacetone, anilinoethanol, hydroxyurea and the like are known.

In recent years, for an economical and an environmental reason, a developing solution tends not to be positively replenished, so that its stagnatory period is apt to be prolonged and it thus undergoes an air oxidation more often.

Further, for the acceleration of the processing, a method has been developed in which a monochrome developing agent such as 3-pyrazolidone, hydroquinone or its derivative is added to the color developing agent in order to facilitate a development by virtue of its superadditivity, but such a monochrome developing agent is excessively unstable in the color developing solution which cannot accept a great amount of a sulfite because of a bad influence on a photographic performance. Furthermore, as another means for the precessing acceleration, a light-sensitive photographic material tends to be processed at a high temperature of 30° C. or more, therefore, a problem of the deterioration in the developing solution which is due to its oxidation at the elevated temperature is getting more serious.

SUMMARY OF THE INVENTION

In view of the above-mentioned problems, a first object of this invention is to provide a method for processing of a light-sensitive silver halide color photographic material (hereinafter referred to as the light-sensitive color material) by the use of a color developing solution which is excellent in a storability for a long period of time and a resistance to the processing.

A second object of this invention is to provide a method for processing of a light-sensitive color material by the use of a color developing solution which can prevent the generation of tar or a sludge due to the oxidation of the color developing agent during a prolonged storage period.

In addition, a third object of this invention is to provide a method for processing of a light-sensitive color material which does not bring about any contamination of a processing tank in an automatic developing machine and any clogging of a filter with tar or a sludge.

A method for processing of the light-sensitive color material according to this invention is characterized by carrying out, after an image exposure of said material, a development processing of said material in the presence of the following components (A), (B) and (C) and/or (D):

(A) an aromatic primary amine color developing agent compound;

(B) a manganese salt and/or a cerium salt;

(C) a diphosphonic acid sequestering agent and a magnesium salt and/or a lithium salt; and (D) at least one of the sequestering agent selected from the group consisting of the compounds represented by the formulas (I), (II), (III), (IV) and (V):

(I)

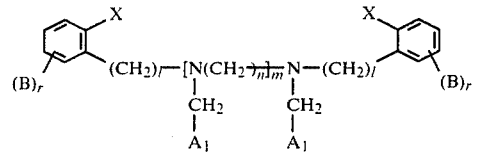

wherein $A_1$ represents a carboxylic acid group, a phosphoric acid group or a salt thereof; X represents a hydroxyl group or a salt thereof; B represents a halogen atom, a hydroxyl group, an alkyl group, a carboxylic acid group, a phosphoric acid group, or salts of a hydroxyl group, a carboxylic acid group or a phosphoric acid group; r and l each are integer of 0, 1 or 2; and n is an integer of 1 to 4; and m is an integer of 0 to 3, (II)

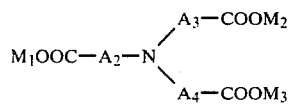

(III)

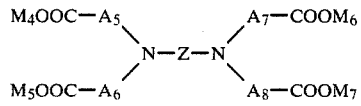

wherein $A_2$, $A_3$, $A_4$, $A_5$, $A_6$, $A_7$ and $A_8$ each represent an alkylene group; Z represents a divalent organic group; and $M_1$ to $M_7$ each represent a hydrogen atom or an alkaline metal atom,

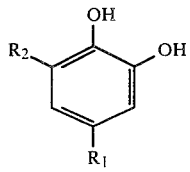

(IV)

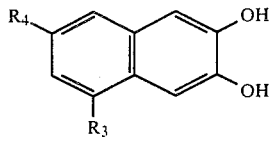

(V)

wherein $R_1$, $R_2$, $R_3$ and $R_4$ each represent a hydrogen atom, a halogen atom, a sulfonic acid group, an alkyl group having 1 to 7 carbon atoms, —$OR_5$, —$COOR_6$,

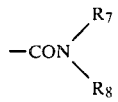

or a phenyl group; and $R_5$, $R_6$, $R_7$ and $R_8$ each represent a hydrogen atom or an alkyl group having 1 to 18 carbon atoms; provided that when $R_2$ represents —OH or a hydrogen atom, $R_1$ represents a halogen atom, a sulfonic acid group, an alkyl group having 1 to 7 carbon atoms, —$OR_5$, —$COOR_6$,

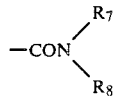

or a phenyl group.

Further, in the present invention, the development process may be carried out in the presence of a monochrome developing agent.

DESCRIPTION OF THE PREFERRED EMBODIMENTS

The aromatic primary amine color developing agent compounds used in this invention are preferably p-phenylenediamine color developing agent compounds. Examples of such compounds include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline and N-ethyl-N,N-β-(β-methoxyethoxy)ethyl-3-methyl-4-aminoaniline, and salts thereof such as sulfates, hydrochlorides, sulfites and p-toluenesulfonates.

The color developing agents just mentioned are generally used in concentrations of about 0.1 g to about 30 g per liter of the developing solution, preferably in concentrations of about 1 g to about 15 g per liter thereof.

Further, the color developing agents may be employed alone or in combination of two or more kinds thereof, and if desired, may be employed in combination with a monochromatic agent such as phenidone, 4-hydroxymethyl-4methyl-1-phenyl-3-pyrazolidone or Metol (trade name; available from Agfa Co., p-methylaminophenol sulfate). Furthermore, the color developing agents may be incorporated into the light-sensitive color material. For example, there can be utilized a process in which the color developing agent is incorporated thereinto in the form of a metallic salt, as in U.S. Pat. No. 3,719,492; a process in which the color developing agent is incorporated in the form of a Schiff salt, as in U.S. Pat. No. 3,342,559 and Research Disclosure No. 15159 (1976); a process in which it is involved as a dye precursor, as in Japanese Provisional Patent Publication Nos. 65429/1983 and 24137/1983; and a process in which it is contained as a color developing agent precursor, as in U.S. Pat. No. 3,342,597. Concrete examples of the dye precursors include, 2',4'-bismethanesulfonamido-4-diethylaminodiphenylamine, 2'-methanesulfonamido-4'-(2,4,6-triisopropyl)benzenesulfonamido-2-methyl-4-N-(2-methanesulfonamidoethyl)ethylaminodiphenylamine, 2'-methanesulfonamido-4'-(2,4,6-triisopropyl)benzenesulfonamido-4-(hydroxytrisethoxy)diphenylamine, 4-N-(2-methanesulfonamidoethyl)ethylamino-2-methyl-2',4'-bis-(2,4,6-triisopropyl)benzenesulfonamidodiphenylamine, 2,4'-bismethanesulfonamido-4-N,N-diethylaminodiphenylamine, 4-n-hexyloxy-2'-methanesulfonamido-4'-(2,4,6-triisopropyl)benzenesulfonamidodiphenylamine, 4-methoxy-2'-methanesulfonamido-4'-(2,4,6-triisopropyl)benzenesulfonamidodiphenylamine, 4-dihexylamino-4'-(2,4,6-triisopropylbenzenesulfonamido)diphenylamine, 4-n-hexyloxy-3'-methyl-4'-(2,4,6-triisopropylbenzenesulfonamido)diphenylamine, 4-N,N-diethylamino-4'-(2,4,6-triisopropylbenzenesulfonamido)diphenylamine, 4-N,N-dimethylamino-2-phenylsulfonyl-4'-(2,4,6-triisopropylbenzenesulfonamido)diphenylamine, and the like.

The amount of the aforesaid dye precursor to be added to the light-sensitive material is preferably within the range of 0.5 to 22 mg, more preferably 4 to 12 mg per 100 $cm^2$ of the light-sensitive material.

The above-mentioned manganese salts and cerium salts are compounds which can release manganese ions or cerium ions when dissolved in the developing solution. Their preferred examples will be enumerated below, but they are not restrictive:

Manganese chloride
Manganese sulfate
Manganese sulfite
Manganese bromide
Manganese phosphate
Manganese nitrate
Potassium permanganate
Manganese acetate
Manganese oxalate
Manganese citrate
(Ethylenediaminetetraacetato)manganese salt
Cerium sulfate
Cerium nitrate
Cerium chloride
Cerium carbonate
Cerium phosphate
Cerium acetate
Cerium citrate
Cerium oxalate (1,2-Cyclohexanediaminetetraacetato)cerium salt Each of these manganese salts and cerium salts can be used in the form of ions (manganese ions and cerium ions) within the amount range of 0.1 mg to 20 mg, preferably 0.3 mg to 8 mg, per liter of the developing solution.

Further, the manganese salts may each have any valence number of two, three, four, six and seven, but in this invention, divalent manganese salts are preferred. With regard to the cerium salts, they may each have any valence number of three or four. However, trivalent cerium salts are particularly preferably used.

Moreover, these manganese salts and cerium salts may be incorporated into the light-sensitive color material.

The diphosphonic acid sequestering agent to be used in this invention may be employed a mixture of two or more of a diphosphonic acid sequestering agent, and particularly preferable compounds for this invention include the compound represented by the following formula (VI) and derivatives thereof:

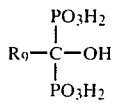

(VI)

wherein $R_9$ represents an alkyl group having 1 to 5 carbon atoms.

In addition to the above, available diphosphonic sequestering agents to be used in this invention include the compound represented by the following formula (VII) and derivatives thereof:

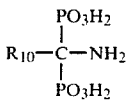

(VII)

wherein $R_{10}$ represents an alkyl group having 1 to 5 carbon atoms.

Typical examples of compounds included in the formulas (VI) and (VII) may be mentioned, for example, (VI-1) 1-hydroxyethylidene-1,1-diphosphonic acid, (VI-2) 1-hydroxypropylidene-1,1-diphosphonic acid; and as to the latter amino phosphonic acid, (VII-1) 1-aminoethane-1,1-diphosphonic acid, (VII-2) 1-aminopropane-1,1-diphosphonic acid, and the like. These diphosphonic acid may be employed as an alkali metal salt such as a potassium salt or a sodium salt, an ammonium salt or an aqueous amine salt such as a triethanolammonium salt or trimethylammonium salt.

In this invention, the above-mentioned diphosphonic acid sequestering agents can be employed in amounts of 0.01 g to 10 g, preferably 0.1 g to 10 g per liter of the developing solution, with the result that good effects can be obtained.

Further, a magnesium salt and a lithium salt to be preferably used in this invention are mentioned below, but this invention is not limited thereto.

Magnesium chloride
Magnesium sulfate
Magnesium acetate
Magnesium nitrate
Magnesium bromide
Magnesium phosphate
Magnesium oxalate
Magnesium citrate
Lithium chloride
Lithium sulfate
Lithium nitrate
Lithium phosphate
Lithium acetate Each of these magnesium salts and lithium salts can be used in combination with the aforesaid diphosphonic acid, and are added to the aim of preventing the precipitation of the diphosphonic acid. Each of these magnesium salt and lithium salt may be used singly in the combination with the diphosphonic acid, or both of the magnesium salts and the lithium salts may be used simultaneously in combination with the diphosphonic acid. Each of these magnesium salt and lithium salt may be employed in the developing solution in amounts of $\frac{1}{2}$ to 3 fold of moles based on the diphosphonic acid sequestering agent according to this invention.

In the sequestering agent represented by the above formula (III), Z represents preferably an alkylene group, a cycloalkylene group or an alkylene group including an oxygen atom or nitrogen atom, and as the alkylene group including the oxygen atom or nitrogen atom, a group represented by the following formula (a) or (b) is preferred:

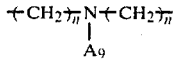

(a)

wherein n is as defined in formula (I); and $A_9$ represents a lower aliphatic carboxylic acid, $$-L-O-L-O-L- \quad \text{(b)}$$

wherein L represents an alkylene group such as an ethylene group.

In the above formula (IV) and (V), as the alkyl group represented by $R_1$, $R_2$, $R_3$ and $R_4$, there may be included, for example, a methyl group, an ethyl group, an isopropyl group, an n-propyl group, a t-butyl group, an n-butyl group, a hydroxymethyl group, a hydroxyethyl group, a methylcarboxylic acid group and a benzyl group, and as the alkyl group represented by $R_5$, $R_6$, $R_7$ and $R_8$, there may be further included an octyl group in addition to the above mentioned alkyl group.

Further, as the phenyl group represented by $R_1$, $R_2$, $R_3$ and $R_4$, there may be included a phenyl group, a 2-hydroxyphenyl group and 4-aminophenyl group.

Next, typical examples of the compound used in the invention and represented by the formula (I) will be enumerated below, but they are not restrictive.

Exemplary compounds

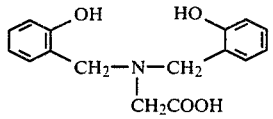

I-1

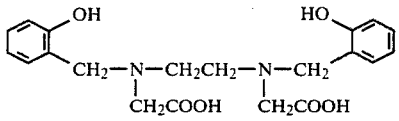

I-2

-continued

Exemplary compounds

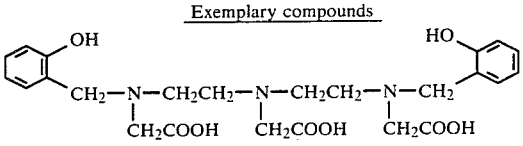

I-3

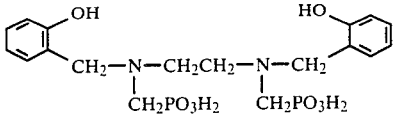

I-4

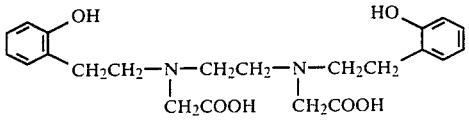

I-5

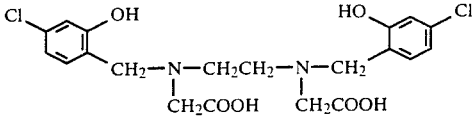

I-6

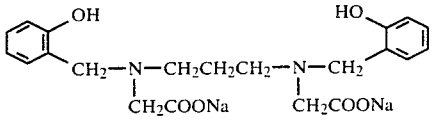

I-7

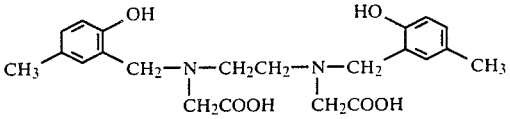

I-8

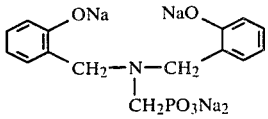

I-9

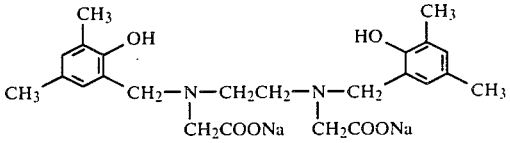

I-10

These compounds just mentioned can be synthesized by such general synthetic process as described in U.S. Pat. No. 3,632,637 and "Journal of the American Chemical Society", Vol. 89, 1967, p. 837.

Now, typical examples of compounds represented by the aforesaid formulas (II) or (III) and preferably used in this invention will be enumerated below, but they do not intend to limit this invention:

II-1 Trisodium nitrilotriacetate
II-2 Nitrilotripropionic acid
II-3 Nitrilodiacetic propionic acid
III-1 Pentasodium diethylenetriaminepentaacetate
III-2 Glycol etherdiaminetetraacetate
III-3 1,3-diamino-2-propanoltetraacetic acid
III-4 Cyclohexanediaminetetraacetic acid
III-5 Disodium ethylenediaminetetraacetate
III-6 1,2-Diaminopropane-N,N,N',N'-tetraacetic acid Among the compounds represented by the formulas (II) and (III), diethylenetriaminepentaacetic acid and 1,3-diamino-2-propanoltetraacetic acid are particularly preferred.

Typical examples of compounds represented by the aforesaid formulas (IV) or (V) and preferably used in this invention will be enumerated below, but they do not intend to limit this invention:

IV-1 4-Propyl-1,2-dihydroxybenzene
IV-2 1,2-Dihydroxybenzene-3,5-disulfonic acid
IV-3 1,2,3-Trihydroxybenzene-5-carboxylic acid
IV-4 Methyl 1,2,3-trihydroxybenzene-5-carboxylate
IV-5 n-Butyl 1,2,3-trihydroxybenzene-5-carboxylate
V-1 2,3-Dihydroxynaphthalene-6-sulfonic acid
V-2 2,3,8-Trihydroxynaphthalene-6-sulfonic acid
V-3 2,3-Dihydroxynaphthalene-6-carboxylic acid
V-4 2,3-Dihydroxy-8-isopropylnaphthalene
V-5 2,3-Dihydroxy-8-chloronaphthalene-6-sulfonic acid Among above compounds, particularly preferably used in this invention is 1,2-dihydroxybenzene-3,5-disulfonic acid, and it may also be used as an alkali metal salt such as sodium salt or potassium salt.

In this invention, the compounds represented by the aforesaid formula (I) can be employed in amounts of 3 mg to 1 g, preferably 5 mg to 0.5 g, more preferably 8 mg to 0.1 g per liter of the developing solution, with the result that good effects can be obtained. Further, the compounds represented by the aforesaid formulas (II) and (III) can be employed in amounts of 0.1 g to 5 g, preferably 0.5 g to 3 g per liter of the developing solution in order to obtain good results. Moreover, the compounds represented by the aforesaid formulas (IV) and (V) can be employed in amounts of 5 mg to 20 g, preferably 10 mg to 10 g, more preferably 20 mg to 3 g per liter of the developing solution, thereby obtaining satisfactory results.

The compounds represented by the formulas (I), (II), (III), (IV) or (V) may be used alone or in a combination thereof. Moreover, they may be employed in combination with other chelating agent such as an aminopolyphosphonic acid e.g. aminotri(methylenephosphonic acid) or ethylenediaminetetraphosphoric acid; an oxycarboxylic acid e.g. citric acid or gluconic acid; a phosphonocarboxylic acid e.g. 2-phosphonobutane-1,2,4-tricarboxylic acid; polyphosphoric acid e.g. tripolyphosphoric acid or hexamethaphosphoric acid; and the like.

In the present invention, when (the aromatic primary amine color developing agent compound), (the manganese salt and/or the cerium salt) and (the diphosphonic acid sequestering agent and the magnesium salt and/or the lithium salt) coexist or when (the aromatic primary amine color developing agent compound), (the manganese salt and/or the cerium salt) and (at least one of the sequestering agents selected from the group consisting of the compounds represented by the formulas (I), (II), (III), (IV) and (V)) coexist, the object of this invention will be accomplished. On the other hand, it is impractical when one of them is employed singly or when any one of them are lacking for the developing solution, because of generation of various defects. For example, when the developing solution is lacking for a pack of (a manganese salt and/or a cerium salt), oxdation of the color developing agent will be remarkable during the long period of presevation thereof, and when it is lacking for the aforesaid diphosphonic acid or a pack of the sequestering agents represented by the formulas (I), (II), (III), (IV) and (V), the developing solution will become impractical since the preservatives such as hydroxylamine in the developing solution are decomposed by the existing manganese salt or cerium salt therein. For these reasons, it is indispensable that, in this invention as mentioned above, all the constitutional components in this invention are combinedly used.

Further, when the other metal salts such as ferric salts, copper salts or barium salts are employed in place of the manganese salt and the cerium salt according to this invention, the effect which intends to the present invention has not been obtained, and when the other sequestering agent such as oxycarboxylic acids e.g. polyphosphoric acid, citric acid and oxalic acid; aminopolyphosphoric acids; hydroxyiminodiacetic acids or phosphonocarboxylic acids are employed in place of the sequestering agent according to this invention, they do not show the effect to be intended by the present invention.

However, in addition to the sequestering agents according to this invention, other sequestering agents such as polyphosphoric acid, oxycarboxylic acid, aminopolyphosphoric acid, hydroxypolycarboxylic acid, phosphonocarboxylic acid and the like may optionally be employed.

In the present invention, by further carrying out the color developing processing in the presence of a monochrome developing agent, good results can be obtained.

The above-mentioned monochrome developing agents used in this invention are developing agents which react with couplers but produce no dyes. Examples of the monochrome developing agents which are represented by the following formula (VIII) include 3-pyrazolidone, hydroquinone, aminophenols and phenylenediamines:

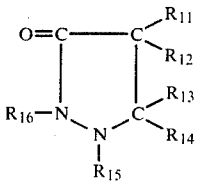

(VIII)

wherein $R_{11}$, $R_{12}$, $R_{13}$ and $R_{14}$ each represent a hydrogen atom, an alkyl group or an aryl group; $R_{15}$ represents an aryl group; and $R_{16}$ represents a hydrogen atom or an acetyl group.

Now, concrete examples of the monochrome developing agents used in this invention will be enumerated, but they are not restrictive.

Exemplary compounds:

i-1

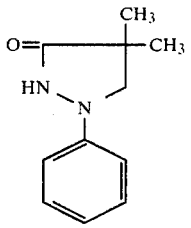

i-2

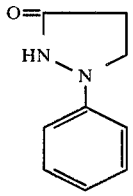

-continued

Exemplary compounds:

i-3

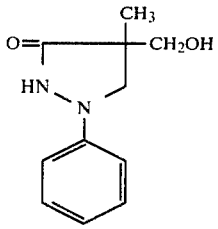

i-4

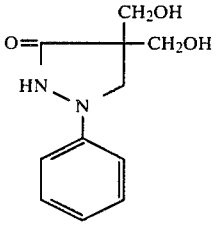

i-5

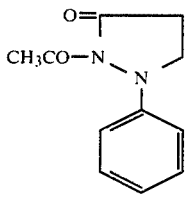

i-6

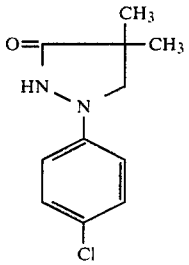

i-7

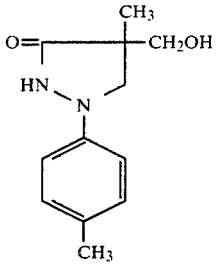

i-8

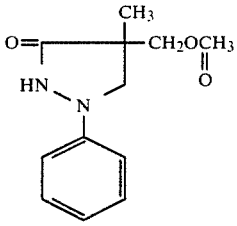

-continued

Exemplary compounds:

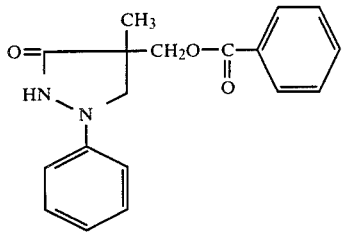

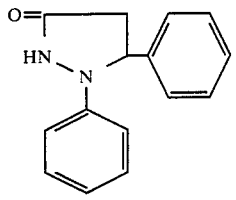

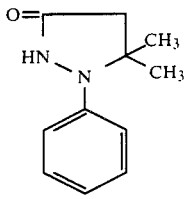

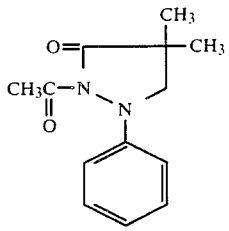

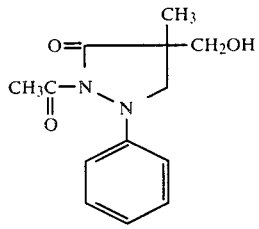

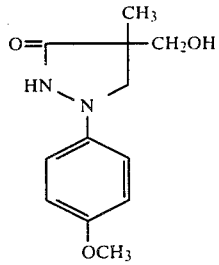

i-9 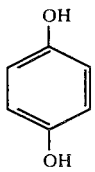

ii-1 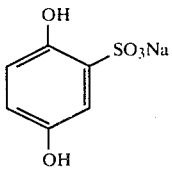

-continued

Exemplary compounds:

i-10 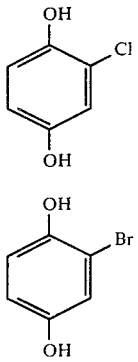

i-11 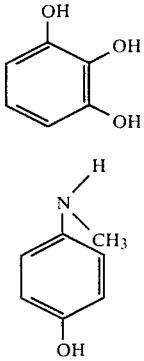

i-12 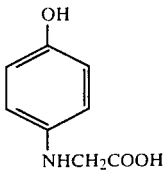

i-13 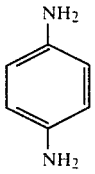

i-14 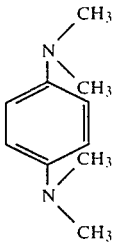

ii-2 ii-3 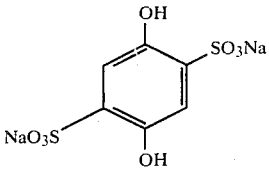

ii-4 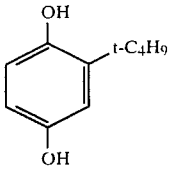

ii-5 ii-6 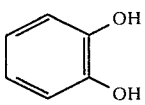

ii-7 ii-8 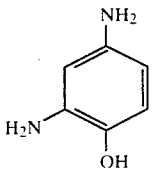

iii-1 iii-2 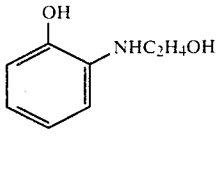

iii-3 iii-4 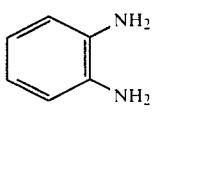

iv-1 iv-2 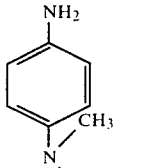

iv-3 iv-4

These monochrome developing agents may usually be used in the forms of sulfates, hydrochlorides, nitrates, nitrites and p-toluenesulfonates, but may take forms other than salts. The monochrome developing agents are generally employed in concentrations of about 3 mg to 10 g per liter of the developing agent, preferably in concentrations of 5 mg to 5 g per liter thereof. Further, the monochrome developing agents may be used alone or in combination of two or more kinds thereof. Furthermore, each monochrome developing agent may be incorporated into the light-sensitive color material. For example, there are known a process in which 3-pyrazolidone is incorporated thereinto, as in Japanese Provisional Patent Publication Nos. 50532/1983 and 50536/1983 as well as U.K. Pat. No. 1,032,925; a process in which catechol or a hydroquinone derivative is dispersed into an emulsion, as in U.S. Pat. Nos. 2,592,368 and 3,300,307 as well as U.K. Pat. No. 1,177,488; a process in which hydroquinone, pyrogallol, p-aminophenol or the like is substituted by a group, is dissolved in a solvent, and is dispersed in the form of globules into an emulsion in order to accomplish its incorporation, as in U.K. Pat. No. 954,391; and a process in which an incorporation is achieved in the form of a precursor, as in U.S. Pat. Nos. 3,379,529 and 3,246,988 as well as U.K. Pat. Nos. 1,055,920 and 1,066,991.

Of these monochrome developing agents, 3-pyrazolidone and its derivatives are particularly preferable in point of the effect of superadditivity.

The aromatic primary amine color developing agent, the monochrome developing agent, the manganese salt and/or cerium salt regarding to this invention are used in such a ratio that (the aromatic primary amine color developing agent):(the monochrome developing agent):(the manganese salt and/or cerium salt) is (0.01 to 10,000):1:(0.00001 to 7).

The color developing solution which is processed in the presence of the aforementioned organic and inorganic compounds regarding this invention may contain and alkali agent usually used in a developing solution, for example, sodium hydroxide, potassium hydroxide, ammonium hydroxide, sodium carbonate, potassium carbonate, sodium sulfate, sodium metaborate or sodium tetraborate decahydrate. Further, in the color developing solution, there can be contained a variety of additives, for example, benzyl alcohol, a halogenated alkali metal such as potassium bromide or potassium chloride, a developing regulator such as citrazinic acid, and a preservative such as hydroxylamine or a sulfite.

Furthermore, it is possible to suitably include, in the color developing solution, an antifoam, a surface active agent, and an organic solvent such as methanol, dimethylformamide or dimethyl sulfoxide.

A pH value of the color developing solution regarding this invention is usually 7 to more, preferably within the range of about 9 to 13.

Moreover, in the color developing solution used in this invention, an antioxidant may be contained, if desired, and examples of the antioxidants include hydroxylamine, ascorbic acid, tetronic acid, tetronic imide, 2-anilinoethanol, dihydroxyacetone, aromatic secondary alcohol, hydroxamic acid, pentose, hexose and pyrogalol-1,3dimethyl ether.

The method for processing of this invention can be applied to the processing of usual light-sensitive silver halide color photographic materials such as color negative films, color papers, color positive films, color reversal films and color reversal papers.

EXAMPLES

Now, this invention will be described in detail with reference to examples, but they do not intend to limit this invention.

EXAMPLE 1

(Experiment 1)

An experiment was carried out using the following color developing solution for a color negative film:

| (Composition of the color developing solution) | |
|---|---|
| Potassium carbonate | 30 g |
| Sodium bicarbonate | 2.5 g |
| Potassium sulfite | 5 g |
| Sodium bromide | 1.3 g |
| Potassium iodide | 2 mg |
| Hydroxylamine sulfate | 2.5 g |
| Sodium chloride | 0.6 g |
| N—Ethyl-N—(β-hydroxyethyl)-3-methyl-p-phenylene diamine sulfate (color developing agent) | 4.8 g |
| Potassium hydroxide | 1.2 g |
| Made up to one liter with addition of water and adjusted to pH 10.06 with potassium hydroxide or 20% sulfuric acid. | |

This developing solution was named Comparative Sample 1. The metallic salts and sequestering agents which were shown in Table 1 below were added to the Comparative Sample 1, and one liter of the developing solution was stored at room temperature for 20 days in a 1 liter beaker having an opening area of 100 $cm^2$. After the storage, a decomposed color developing agent in the developing solution was quantitatively determined, and its absorption at 450 nm was measured by means of a spectrophotometer in order to obtain a tar degree of the developing solution.

(Experiment 2)

Sakura Color II negative film (manufactured by Konishiroku Photo Industry Co., Ltd.) was subjected to a white light stepwise exposure by the use of a KS-7 type light sensor (manufactured by Konishiroku Photo Industry Co., Ltd.), and a color developing processing was then carried out using the developing solution Nos. 1 to 31 which had already been allowed to stand for 4 days in Experiment 1, in accordance with the following process:

| Process | Temperature (°C.) | Time (min) |
|---|---|---|
| Color development | 38 | 3 min. 15 sec. |
| Bleach | 38 | 6 min. 30 sec. |
| Washing | 33 | 3 min. |
| Fixing | 38 | 6 min. 30 sec. |
| Washing | 33 | 4 min. |
| Stabilizing | 33 | 2 min. |
| Drying | 43 to 52 | |

The used bleaching solution, fixing solution and stabilizing solution all were a Sakura Color negative film processing agent, Type-4 (CNK-4) (manufactured by Konishiroku Photo Industry Co., Ltd.).

For each of the samples which had undergone the above-mentioned color developing processing, a maximum density of a blue density was measured by the use of a PDA-60 type photoelectric densitometer (manufactured by Konishiroku Photo Industry Co., Ltd.).

The results of the aforementioned measurements are shown below in Table 2 all together.

TABLE 1

| Developing solution No. | Metallic salt (amount as metallic ions) | Sequestering agent |
|---|---|---|
| 1 (Comparative Sample) | Absent | Absent |
| 2 (Sample of this invention) | $MnSO_4$ ($Mn^{2+}$ 1 mg/l) | I-10 (40 mg/l) |
| 3 (Sample of this invention) | $Ce(SO_4)_2$ ($Ce^{4+}$ 1 mg/l) | I-7 (30 mg/l) |
| 4 (Sample of this invention) | $MnCl_2$ (1 mg/l) | II-1 (3 g/l) |
| 5 (Sample of this invention) | $MnSO_4$ (1 mg/l) | III-1 (3 g/l) |
| 6 (Sample of this invention) | $CeCl_4$ (1 mg/l) | III-3 (3 g/l) |
| 7 (Sample of this invention) | $MnSO_4$ (1 mg/l) | IV-2 (0.2 g/l) |
| 8 (Sample of this invention) | $Ce(SO_4)_2$ (1 mg/l) | IV-2 (0.2 g/l) |
| 9 (Sample of this invention) | $MnCl_2$ (1 mg/l) | IV-3 (0.2 g/l) |
| 10 (Sample of this invention) | $CeCl_4$ (1 mg/l) | IV-5 (0.2 g/l) |
| 11 (Sample of this invention) | $CeCl_3$ (1 mg/l) | V-1 (0.2 g/l) |
| 12 (Sample of this invention) | $MnCl_2$ (1 mg/l) | VI-1 (0.2 g/l) + $MgSO_4$ (0.2 g/l) |
| 13 (Sample of this invention) | $Mn(NO_3)_2$ (1 mg/l) | VII-1 (0.2 g/l) + $MgCl_2$ (0.2 g/l) |
| 14 (Sample of this invention) | $Mn(CH_3COO)_2$ (1 mg/l) | VI-1 (0.2 g/l) + $Li_2SO_4$ (0.2 g/l) |
| 15 (Comparative Sample) | $FeCl_3$ (1 mg/l) | VI-1 (0.2 g/l) + $MgSO_4$ (0.2 g/l) |
| 16 (Comparative Sample) | $CuSO_4$ (1 mg/l) | VI-1 (0.2 g/l) + $MgSO_4$ (0.2 g/l) |
| 17 (Comparative Sample) | $CaCl_2$ (1 mg/l) | VI-1 (0.2 g/l) + $MgSO_4$ (0.2 g/l) |
| 18 (Comparative Sample) | $CoCl_2$ (1 mg/l) | VI-1 (0.2 g/l) + $MgSO_4$ (0.2 g/l) |
| 19 (Comparative Sample) | Absent | VI-1 (0.2 g/l) + $MgSO_4$ (0.2 g/l) |
| 20 (Comparative Sample) | Absent | III-1 (3 g/l) |
| 21 (Comparative Sample) | $FeCl_3$ (1 mg/l) | IV-2 (0.2 g/l) |
| 22 (Comparative Sample) | $CuSO_4$ (1 mg/l) | IV-2 (0.2 g/l) |
| 23 (Comparative Sample) | $CaCl_2$ (1 mg/l) | IV-2 (0.2 g/l) |
| 24 (Comparative Sample) | $CoCl_2$ (1 mg/l) | IV-2 (0.2 g/l) |
| 25 (Comparative Sample) | Absent | IV-2 (0.2 g/l) |
| 26 (Comparative Sample) | Absent | IV-5 (0.2 g/l) |
| 27 (Comparative Sample) | $MnSO_4$ (1 mg/l) | Absent |
| 28 (Comparative Sample) | $Ce(SO_4)_2$ (1 mg/l) | Absent |
| 29 (Comparative Sample) | $MnSO_4$ (1 mg/l) | Hexamethaphosphoric acid (3 g/l) |
| 30 (Comparative Sample) | $MnSO_4$ (1 mg/l) | 2-Phosphonobutane-1,2,4-tricarboxylic acid (2 g/l) |
| 31 (Comparative Sample) | $MnSO_4$ (1 mg/l) | Hydroxyiminodiacetic acid (2 g/l) |

TABLE 2

| Developing solution No. | (Experiment 1) Amount of decomposed color developing agent (%) | (Experiment 1) Tar degree of developing solution (*1) | (Experiment 2) Maximum density |
|---|---|---|---|
| 1 (Comparative Sample) | 16.5 | 0.98 | 2.11 |
| 2 (Sample of this invention) | 0.5 | 0.11 | 2.78 |
| 3 (Sample of this invention) | 3.5 | 0.15 | 2.70 |
| 4 (Sample of this invention) | 2.9 | 0.10 | 2.69 |
| 5 (Sample of this invention) | 0.2 | 0.11 | 2.79 |
| 6 (Sample of this invention) | 3.5 | 0.13 | 2.69 |
| 7 (Sample of this invention) | 0.5 | 0.12 | 2.77 |
| 8 (Sample of this invention) | 0.2 | 0.09 | 2.79 |
| 9 (Sample of this invention) | 1.0 | 0.15 | 2.73 |
| 10 (Sample of this invention) | 1.2 | 0.13 | 2.71 |
| 11 (Sample of this invention) | 2.3 | 0.15 | 2.72 |
| 12 (Sample of this invention) | 0.3 | 0.09 | 2.78 |
| 13 (Sample of this invention) | 1.7 | 0.12 | 2.74 |
| 14 (Sample of this invention) | 0.4 | 0.09 | 2.75 |
| 15 (Comparative Sample) | 18.4 | 1.05 | 2.02 |
| 16 (Comparative Sample) | 21.5 | 1.11 | 1.95 |
| 17 (Comparative Sample) | 16.7 | 0.95 | 2.13 |
| 18 (Comparative Sample) | 17.1 | 0.99 | 2.09 |
| 19 (Comparative Sample) | 16.9 | 1.01 | 2.00 |
| 20 (Comparative Sample) | 16.3 | 0.96 | 2.01 |
| 21 (Comparative Sample) | 17.8 | 1.00 | 2.00 |
| 22 (Comparative Sample) | 20.4 | 1.09 | 1.88 |
| 23 (Comparative Sample) | 16.5 | 0.96 | 2.14 |
| 24 (Comparative Sample | 18.0 | 1.03 | 1.98 |
| 25 (Comparative Sample) | 16.8 | 1.01 | 2.00 |
| 26 (Comparative Sample) | 16.7 | 0.96 | 2.01 |
| 27 (Comparative Sample) | 18.7 | 0.18 | 2.01 |
| 28 (Comparative Sample) | 20.5 | 0.25 | 1.98 |
| 29 (Comparative Sample) | 21.9 | 0.16 | 1.92 |
| 30 (Comparative Sample) | 18.3 | 0.19 | 2.06 |
| 31 (Comparative Sample) | 19.5 | 0.20 | 2.14 |

(*1) A coloring degree of each developing solution is represented with an absorbance at 450 nm, and it is indicated thereby that the lower the absorbance is, the smaller the coloring degree is and the lower a tar degree is.

As understood from the aforementioned results, in the developing solution Nos. 2 to 14 regarding this invention, the amount of each decomposed color developing agent is small, the tar degree of each developing solution is extremely low, and the deterioration in the maximim density based on sensitometry is also excessively small.

On the other hand, with regard to the Comparative Samples Nos. 15 to 31 and 1, the amount of each decomposed color developing agent is large, the tar degree of each developing solution is hight, and the deterioration in the maximum density is remarkably great. Therefore, these samples are not practical.

The aforementioned results also indicate that when the metallic salts (manganese salts and cerium salts) regarding this invention are not employed or when other metallic salts are used, the tar degree of the developing solution will be high, the tar content will be thus increased, the decomposed color developing agent will be large, and a developing activity will be deteriorated.

EXAMPLE 2

(Experiment 3)

An experiment was carried out in the same manner as in Experiment 1 except that the following color developing solution which was named Comparative Sample No. 32 and, the metallic salts and sequestering agents which were shown in Table 3 below were employed. After the storage, a decomposed monochrome developing agent in the developing solution was quantitatively determined, and its absorption at 450 nm was measured by means of a spectrophotometer in order to obtain a coloring degree of the developing solution.

| (Compositon of the color developing solution) | |
|---|---|
| Potassium carbonate | 30 g |
| Benzyl alcohol | 17 ml |
| Ethylene glycol | 15 ml |
| Potassium sulfite | 2 g |
| Potassium bromide | 0.7 g |
| Hydroxylamine sulfate | 3 g |
| 3-Methyl-4-amino-N—ethyl-N—(β-methanesulfonamidoethyl)aniline sulfate | 4.8 g |
| Brightening agent (4,4'-diaminostilbene-disulfonic acid derivative) | 1 g |
| Exemplified compound (i-3) | 100 mg |
| Potassium hydroxide | 2 g |
| Made up to one liter with addition of water and adjusted to pH 10.2 with potassium hydroxide or 20% sulfuric acid. | |

(Experiment 4)

Sakura Color PC Paper Type S II (manufactured by Konishiroku Photo Industry Co., Ltd.) was subjected to a white light stepwise exposure by the use of a KS-7 type light sensor (which was manufactured by Konishiroku Photo Industry Co., Ltd.), and a color developing processing was then carried out using the developing solution Nos. 32 to 45 which had already been allowed to stand for 20 days in Experiment 3, in accordance with the following process:

| Process | Temperature (°C.) | Time (min) |
|---|---|---|
| Color development | 33 | 2 |
| Bleach-fix | 33 | 1.5 |
| Washing | 25 to 35 | 1 |
| Drying | 75 to 80 | 1 |

The used bleach-fixing bath was a Sakura Color Paper processing agent, CPK-15 (manufactured by Konishiroku Photo Industry Co., Ltd.).

For each of the samples which had undergone the above-mentioned color developing processing, a maximum density of a blue density was measured by the use of a PDA-60 type photoelectric densitometer (manufactured by Konishiroku Photo Industry Co., Ltd.).

The results of the aforementioned measurements are shown below in Table 4 all together.

TABLE 3

| Developing solution No. | Metallic salt (amount as metallic ions) | Sequestering agent |
|---|---|---|
| 32 (Comparative Sample) | Absent | Absent |
| 33 (Sample of this invention) | $Ce_2(SO_4)_3$ (1 ppm) | Absent |
| 34 (Sample of this invention) | $Ce(SO_4)_2$ (1 ppm) | Absent |
| 35 (Sample of this invention) | $CeCl_3$ (1 ppm) | VI-1 (0.5 g/l) |
| 36 (Sample of this invention) | $CeCl_3$ (1 ppm) | I-2 (0.5 g/l) |
| 37 (Sample of this invention) | $CeCl_3$ (1 ppm) | Sodium hexamethaphosphate (0.5 g/l) |
| 38 (Sample of this invention) | $MnSO_4$ (1 ppm) | VI-1 (0.5 g/l) |
| 39 (Sample of this invention) | $MnCl_2$ (1 ppm) | III-1 (0.5 g/l) |
| 40 (Comparative Sample) | $FeCl_3$ (1 ppm) | Absent |
| 41 (Comparative Sample) | $FeCl_3$ (1 ppm) | VI-1 (0.5 g/l) |
| 42 (Comparative Sample) | $CoCl_2$ (1 ppm) | Absent |
| 43 (Comparative Sample) | $CuSO_4$ (1 ppm) | Absent |
| 44 (Comparative Sample) | Absent | VI-1 (0.5 g/l) |
| 45 (Comparative Sample) | Absent | I-2 (0.5 g/l) |

TABLE 4

| Developing solution No. | (Experiment 3) Amount of decomposed monochrome developing agent (%) | (Experiment 3) Coloring degree of developing solution (*2) | (Experiment 4) Maximum density |
|---|---|---|---|
| 32 (Comparative Sample) | 75.3 | 1.24 | 2.01 |
| 33 (Sample of this invention) | 9.1 | 0.21 | 2.43 |
| 34 (Sample of this invention) | 10.3 | 0.25 | 2.44 |
| 35 (Sample of this invention) | 8.4 | 0.15 | 2.45 |
| 36 (Sample of this invention) | 8.5 | 0.14 | 2.43 |
| 37 (Sample of this invention) | 11.5 | 0.25 | 2.40 |
| 38 (Sample of this invention) | 8.9 | 0.19 | 2.45 |
| 39 (Sample of this invention) | 8.6 | 0.15 | 2.46 |
| 40 (Comparative Sample) | 82.7 | 1.33 | 1.93 |
| 41 (Comparative Sample) | 79.4 | 1.30 | 1.94 |
| 42 (Comparative Sample) | 80.1 | 1.27 | 1.93 |
| 43 (Comparative Sample) | 84.2 | 1.39 | 1.87 |
| 44 (Comparative Sample) | 70.3 | 1.18 | 1.98 |
| 45 (Comparative Sample) | 73.5 | 1.22 | 1.96 |

(*2) A coloring degree of each developing solution is represented with an absorbance at 450 nm, and it is indicated thereby that the lower the absorbance is, the smaller the coloring degree is and the lower a tar degree is.

As understood from the aforementioned results, in the developing solution Nos. 33 to 39 regarding this invention, the amount of each decomposed color developing agent is small, the tar degree of each developing solution is extremely low, and the deterioration in the maximum density based on sensitometry is also excessively small.

On the other hand, with regard to the Comparative Samples Nos. 40 to 45 and 32, the amount of each decomposed color developing agent is large, the tar degree of each developing solution is hight, and the deterioration in the maximum density is remarkable. Therefore, these samples are not practical.

The aforementioned results also indicate that when the metallic salts (manganese salts and cerium salts) regarding this invention are not employed or when other metallic salts are used, the tar degree of the developing solution will be high, the tar content will be thus increased, the decomposed monochrome developing agent will be large, and a developing activity will be deteriorated.

As is further definite from the foregoing, even if no sequestering agent is used, the effects of this invention will be obtained, but when the sequestering agents represented by the formulas (I), (II), (III) and (VI) regarding this invention are employed, the more excellent effects can be obtained.

EXAMPLE 3

The procedure of Example 1 was repeated with the exception that amounts of the manganese ions added to the developing solutions Nos. 4 and 8 in Example 1 were 0, 0.1, 0.3, 0.5, 1.0, 5.0, 8.0, 20.0, 30.0 and 40.0 mg/l. The results are shown in Table 5 below.

TABLE 5

| Developing solution No. | Amounts of manganese ions (mg/l) | Amounts of decomposed color developing solution (%) | Tar degree of developing solution | Maximum density |
|---|---|---|---|---|
| 4 | 0 | 16.7 | 1.02 | 2.15 |
| | 0.1 | 9.2 | 0.38 | 2.48 |
| | 0.3 | 4.1 | 0.15 | 2.60 |
| | 0.5 | 2.7 | 0.09 | 2.71 |
| | 1.0 | 2.9 | 0.10 | 2.69 |
| | 5.0 | 3.3 | 0.10 | 2.67 |
| | 8.0 | 3.8 | 0.11 | 2.66 |
| | 20.0 | 8.3 | 0.10 | 2.52 |
| | 30.0 | 19.4 | 0.11 | 2.10 |
| | 40.0 | 25.1 | 0.12 | 1.80 |
| 8 | 0 | 16.7 | 1.02 | 2.15 |
| | 0.1 | 10.5 | 0.43 | 2.40 |
| | 0.3 | 4.3 | 0.16 | 2.62 |
| | 0.5 | 1.0 | 0.10 | 2.78 |
| | 1.0 | 0.2 | 0.09 | 2.79 |
| | 5.0 | 0.4 | 0.09 | 2.79 |
| | 8.0 | 0.9 | 0.10 | 2.77 |
| | 20.0 | 8.9 | 0.10 | 2.49 |
| | 30.0 | 19.3 | 0.09 | 2.11 |
| | 40.0 | 28.8 | 0.15 | 1.72 |

It can be understood from the above-mentioned results that when each metallic salt (manganese salt) regarding this invention is present in amounts of 0.1 to 20 mg/l in terms of ions, the decomposition of the color developing agent, the tar degree in the developing solution and the developing activity thereof are all good, and when the metallic salt is used within the range of 0.3 to 8 mg/l, especially noticeably excellent results can be obtained.

EXAMPLE 4

By using each developing solutions Nos. 12 and 14 obtained in Example 1, they are carried out the same experiment as in Example 3 using the exemplary compounds I-10, II-1, III-1 and III-3 of the present invention in amounts of 3 g/l, respectively. As results, the same results as in Example 1 were obtained.

EXAMPLE 5

The procedure of Example 2 was repeated with the exception that amounts of the manganese ions added to the developing solution No. 38 in Example 2 were 0, 0.1, 0.3, 0.5, 1.0, 5.0, 8.0, 20.0, 30.0 and 40.0 mg/l. The results are shown in Table 6 below.

TABLE 6

| Amounts of manganese ions (mg/l) | Amounts of decomposed monochrome developing solution (%) | Coloring degree of developing solution | Maximum density |
|---|---|---|---|
| 0 | 16.7 | 1.02 | 2.15 |
| 0.1 | 9.2 | 0.38 | 2.48 |
| 0.3 | 4.1 | 0.15 | 2.60 |
| 0.5 | 2.7 | 0.09 | 2.71 |
| 1.0 | 2.9 | 0.10 | 2.69 |
| 5.0 | 3.3 | 0.10 | 2.67 |
| 8.0 | 3.8 | 0.11 | 2.66 |
| 20.0 | 8.3 | 0.10 | 2.52 |
| 30.0 | 19.4 | 0.11 | 2.10 |
| 40.0 | 25.1 | 0.12 | 1.80 |

It can be undetstood from the above-mentioned results that when each metallic salt (manganese salt) regarding this invention is present in amounts of 0.1 to 20 mg/l in terms of ions, the decomposition of the monochrome developing agent, the tar content in the developing solution and the developing activity thereof are all good, and when the metallic salt is used within the range of 0.3 to 8 mg/l, especially noticeably excellent results can be obtained.

EXAMPLE 6

The procedure of Experiment 1 in Example 1 was repeated with the exception that the basic processing of the color developing solution for the color negative carried out in Experiment 1 of Example 1 was replaced with the following basic processing of the color developing solution for the color paper:

| (Composition of the color developing solution for the color paper) | |
|---|---|
| Benzyl alcohol | 15 ml |
| Ethylene glycol | 15 ml |
| Potassium sulfite | 2 g |
| Potassium bromide | 0.7 g |
| Sodium chloride | 0.2 g |
| Potassium carbonate | 30 g |
| Hydroxylamine sulfate | 3 g |
| 3-Methyl-4-amino-N—ethyl-N—(β-methanesulfonamidoethyl)aniline sulfate | 5.5 g |
| Brightening agent (4,4-diaminostilbene-disulfonic acid derivative) | 1.0 g |
| Potassium hydroxide | 2 g |
| Made up to one liter with addition of water and adjusted to pH 10.2 with potassium hydroxide or 20% sulfuric acid. | |

The same results as in Example 1 were obtained.

EXAMPLE 7

The following experiment was carried out with the exception that hydroxylamine sulfate in the basic processing of the color developing solution for the color paper in Example 6 was excluded.

The developing solution of the said processing was named Comparative Sample No. 46. The compounds which were shown in Table 7 below were added to the Comparative Sample No. 46, and one liter of the developing solution was stored at room temperature for 20 days in a beaker having an opening area of 100 $cm^2$. After the storage, a decomposed color developing agent in the developing solution was quantitatively determined, and its absorption at 450 nm was measured by means of a spectrophotometer in order to obtain a tar degree of the developing solution. The results obtained are shown in Table 8 below.

TABLE 7

| Developing solution No. | Metallic salt (amount as metallic ions) | Sequestering agent (amount) | Hydroxylamine sulfate |
|---|---|---|---|
| 46 (Comparative Sample) | Absent | III-1 (3 g/l) | Absent |
| 47 (Comparative Sample) | Absent | III-1 (3 g/l) | 3 g/l |
| 48 (Sample of this invention) | $MnCl_2$ (1 mg/l) | III-1 (3 g/l) | Absent |
| 49 (Sample of this invention) | $Ce(SO_4)_2$ (1 mg/l) | III-1 (3 g/l) | Absent |

TABLE 8

| Developing solution No. | Amount of decomposed color developing agent (%) | Tar degree of developing solution |
|---|---|---|
| 46 (Comparative Sample) | 14.3 | 0.85 |
| 47 (Comparative Sample) | 2.5 | 0.28 |
| 48 (Sample of this invention) | 1.2 | 0.13 |
| 49 (Sample of this invention) | 1.9 | 0.17 |

As understood from the aforementioned results, in the developing solution Nos. 48 and 49 regarding this invention, the decomposition and the tar degree of the color developing agent is extremely low while hydroxylamine was not included therein.

EXAMPLE 8

(Experiment 5)

The procedure of Experiment 3 in Example 2 was repeated with the exception that the color developing solution for the color paper used in Experiment 3 of Example 2 was replaced with the following color developing solution for a color reversal paper:

| (Composition of the color developing solution) | |
|---|---|
| Benzyl alcohol | 15 ml |
| Ethylene glycol | 15 ml |
| 3-Methyl-4-amino-N—ethyl-N—(β-methanesulfonamidoethyl)aniline sulfate | 5.5 g |
| Potassium sulfite | 5.0 g |
| Hydroxylamine sulfate | 8.0 g |
| Brightening agent (4,4-diaminostilbene-disulfonic acid derivative) | 1.5 g |
| Potassium bromide | 1.0 g |
| Potassium carbonate | 28 g |
| Magnesium chloride hexahydrate | 0.4 g |
| Exemplified compound (i-1) | 0.15 g |
| Made up to one liter with addition of water and adjusted to pH 10.2 with potassium hydroxide or 20% sulfuric acid. | |

(Experiment 6)

The procedure of Experiment 4 in Example 2 was repeated with the exception that the light-sensitive color material used therein is replaced with the following color reversal paper:

(Color reversal paper)

The color reversal paper was prepared by depositing the following layers in turn on a paper support coated with a resin.

Layer 1: Cyan forming red-sensitive silver halide emulsion layer

An internal latent type silver halide emulsion was prepared in accordance with a method which was described in Japanese Provisional Patent Publication No. 127549/1980. That is to say, 200 ml of a 1M aqueous silver nitride solution were promptly added to 220 ml of 1M aqueous potassium chloride solution including 10 g of gelatin at a temperature of 60° C. After physical ripening for 10 minutes, a mixed solution of 200 ml of a 1M aqueous potassium bromide solution and 50 ml of a 0.1M aqueous potassium iodide solution was added thereto. In order to coat the resulting conversion type silver chloroiodobromide grains with silver chloride shells, 150 ml of a 1M aqueous silver nitrate solution were added thereto over 5 minutes, and physical ripening for 20 minutes and a subsequent washing were carried out.

Mixed and dissolved were 70 g of 2,4-dichloro-3-methyl-6-[α-(2,4-di-tert-amylphenoxy)butyramido]-phenol which was a cyan coupler, 50 g of dibutyl phthalate and 140 g of ethyl acetate, and the resulting mixture was then added to a gelatin solution including sodium isopropylnaphthalene sulfonate in order to form an emulsified dispersion.

The thus formed dispersion was then added to the above emulsion which had previously been spectral sensitized by the following dyes:

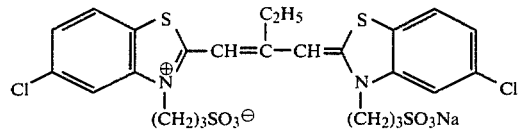

and

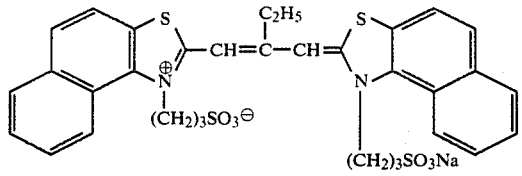

To the emulsion were then added 1 g of 4-hydroxy-6-methyl-1,3,3a,7-tetrazaindene, 1 g of potassium 2,5-dihydroxy-4-sec-octadecylbenzene sulfonate and bis(-vinylsulfonylmethyl)ether which was a hardening agent, and coating was carried out so that the amount of silver halide might be 400 mg/$m^2$ and so that the amount of the coupler might be 460 mg/$m^2$.

Layer 2: Intermediate layer

Coating was made using 100 ml of a 2.5 % gelatin solution including 10 g of 2,5-di-tert-octylhydroquinone dispersed in 5 g of a gray colloidal silver and dibutyl phthalate so that the amount of a colloidal silver might be 400 mg/m$^2$.

Layer 3: Magenta forming green-sensitive silver halide emulsion layer

Mixed and dissolved were 40 g of 1-(2,4,6-trichlorophenyl)-3-(2-chloro-5-octadecylsuccinimidoanilino)-5-pyrazolone which was a magenta coupler, 1 g of 2,5-dit-ert-octylhydroquinone, 75 g of dioctylphthalate and 30 g of ethyl acetate, and the resulting mixture was then added to a gelatin solution including sodium isopropylnaphthalenesulfonate in order to form an emulsified dispersion. The thus formed dispersion was added to the above-mentioned emulsion which had previously been spectral sensitized by the following dyes:

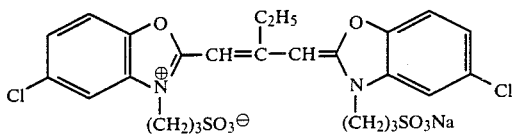

and

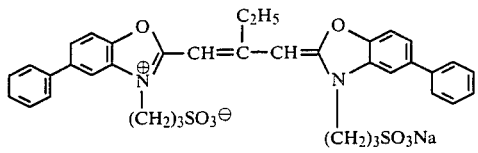

To the emulsion were then added 1 g of 4-hydroxy-6-methyl-1,3,3a,7-tetrazaindene, 1 g of potassium 2,5-dihydroxy-4-sec-octadecylbenzenesulfonate and bis-vinylsulfonylmethyl)ether which was a hardening agent, and coating was carried out so that the amount of silver might be 400 mg/m$^2$ and so that the amount of the coupler might be 400 mg/m$^2$.

Layer 4: Yellow filter layer

Coating was made using a 2.5% gelatin solution including 5 g of 2,5-di-tert-octylhydroquinone dispersed in 5 g of a yellow colloidal silver and dibutyl phthalate so that the amount of a colloidal silver might be 200 mg/m$^2$.

Layer 5: Yellow forming blue-sensitive silver halide emulsion layer

Mixed and dissolved were 80 g of α-[4-(1-benzyl-2-phenyl-3,5-dioxo-1,2,4-triazolyzinyl)]-α-pivaryl-2-chloro-5-[γ-(2,4-di-tert-amylphenoxy)-butyramido]acetoanilide, 1 g of 2,5-di-tert-octylhydroquinone, 80 g of dibutyl phthalate and 200 g of ethyl acetate, and the resulting mixture was then added to a gelatin solution including sodium isopropylnaphthalenesulfonate in order to form an emulsified dispersion. The thus formed dispersion was added to the above-mentioned emulsion. Then, to the emulsion were added 1 g of 4-hydroxy-6-methyl-1,3,3a,7-tetrazaindene and 1 g of 2,5-dihydroxy-4-sec-octadecylbenzenesulfonylmethyl)ether, and bis(vinylsulfonylmethyl)ether which was a hardening agent, and coating was carried out so that the amount of silver might be 400 mg/m$^2$ and so that the amount of the coupler might be 530 mg/m$^2$.

Layer 6: Protective layer

Coating was carried out so that the amount of a gelatin might be 530 mg/m$^2$.

In each of Layers 1, 2, 3, 4, 5 and 6 above, saponin was contained as a coating auxiliary.

The aforementioned samples were subjected to a wedge exposure by the use of a KS-7 type light sensor (manufactured by Konishiroku Photo Industry Co., Ltd.) and were developed in accordance with the following process:

| Process (38° C.) | Time |
|---|---|
| Color development | 1 min. 30 sec. |
| Bleach-fix | 1 min. 30 sec. |
| Washing | 1 min. 30 sec. |

(A light fog exposure was carried out by first immersing each sample in the developing solution for 10 seconds and vertically hitting a light against its light sensitive surface for 10 seconds while the sample is horizontally maintained in the developing solution and at a position 1 cm below its liquid surface.)

With regard to conditions of the light fog exposure, a daylight type fluorescent lamp was used as a light source, and its illumination was adjusted so as to be 1 lux on a light sensitive surface by the use of a neutral density filter.

Further, a composition of a used bleach-fix solution was as follows:

| (Bleach-fix solution) | |
|---|---|
| Ammonium ethylenediaminetetraacetate | 50 g |
| Disodium ethylenediaminetetraacetate | 8 g |
| Ammonium thiosulfate | 100 g |
| Sodium sulfite | 10 g |
| Made up to one liter with addition of water and adjusted to pH 7.0 with ammonium hydroxide or glacial acetic acid. | |

For each of the samples which had undergone the above-mentioned color development processing, a maximum density of a blue color was measured by the use of a PDA-60 type photoelectric densitometer (manufactured by Konishiroku Photo Industry Co., Ltd.).

The procedure of Experiments 5 and 6 described above were repeated, and the obtained results were the same as in Example 2.

EXAMPLE 9

A control sample No. 50 was prepared by removing the monochrome developing agent (exemplified compound (i-3)) from the color developing solution used in Experiment 3 of Example 2, and a developing solution No. 45 was prepared by adding, to the control developing solution No. 50, $CeCl_3$ in an amount of 1 ppm in terms of cerium. A development processing was carried out using the color developing solutions 45 and 50 as well as 1 and 35 in Experiment 3 of Example 2 in order to measure a time till the maximum density of a blue color reached 2.40.

Further, the same storage emperiments as in Experiment 3 of Example 2 were carried out. The results of the aforementioned measurements are shown in Table 9 all together.

TABLE 9

| Developing solution No. | Developing solution | Time necessary to reach maximum density 2.40 | Storability |
|---|---|---|---|
| 50 (Comparative Sample) | Color developing agent only | 3 min. 10 sec. | Δ |
| 1 (Comparative Sample) | Color developing agent + monochrome developing agent | 1 min. 55 sec. | X |
| 35 (Sample | Color developing agent + | 1 min. 55 sec. | O |

TABLE 9-continued

| Developing solution No. | Developing solution | Time necessary to reach maximum density 2.40 | Storability |
|---|---|---|---|
| of this invention) | monochrome developing agent + cerium salt | | |
| 45 (Comparative Sample) | Color developing agent + cerium salt | 3 min. 3 sec. | O |

In this table, the symbol O represents the state that the developing solution was not colored, the symbol Δ represents the medium state between the symbol O and X and the symbol X indicated the state that the developing solutoin was appreciably colored and some tar was thus present therein.

As understood from Table 9, in the instance where the color developing agent was employed alone, the prompt processing could not be achieved and the storability was also bad. In the instance where the combination of the color developing agent and the monochrome developing agent was employed, the prompt processing could be achieved but the storability was bad. In the instance where the combination of the color developing agent and the cerium salt was employed, the storability was good but the prompt processing could be achieved. However, it should be noted that, in the instance where the developing solution No. 35 of this invention was employed, the storability was good and the prompt processing could also be achieved.

EXAMPLE 10

The exemplified compound (i-3) in the developing solution No. 35 used in Experiment 3 of Example 2 was replaced with other compounds (i-3), (i-13), (ii-4), (iii-3), (iv-4) and nothing, and the same development processing as in Experiment 4 of Example 2 were provided by the respective developing solutions were measured.

The obtained results are shown in Table 10 below.

TABLE 10

| Added monochrome developing agent | Sensitivity (*3) |
|---|---|
| i - 2 | 132 |
| i - 1 | 130 |
| i - 13 | 128 |
| ii - 1 | 120 |
| ii - 4 | 119 |
| iii - 3 | 118 |
| iv - 4 | 115 |
| none | 100 |

(*3) Each sensitivity in this table is a relative sensitivity on the basis of regarding, as 100, a sensitivity of the sample including no monochrome developing agent.

The results in Table 10 indicate that if any monochrome developing agent is additionally used, the sensitivity will increase in spite of its slight amount. Further, it will be also understood therefrom that when 3-pyrazolidone and its derivatives out of these monochrome developing agents are used, the effect of superadditivity will be built up.

According to the method for processing of the light-sensitive color material of this invention, the following excellent effects can be obtained.

(1) By virtue of the addition of the compounds regarding this invention, effective components, in the developing solution can be prevented being oxidized or decomposed with air and dissolved oxygen present in the developing solution. Therefore, the efficacy of the developing solution can be kept up for a long period of time, and constant processing results can be always be obtained.

(2) Even if the developing solution is stored for a prolonged period of time, any tar and sludge will not be generated, so that there can be prevented a deposition of soils on the processing tank in an automatic developing machine, a clogging of a used filter and a contamination of a light-sensitive color material which is an article to be processed.

I claim:

1. A method for processing of a light-sensitive silver halide color photographic material characterized by carrying out, after image exposure of said material, development processing of said material in a developing solution containing the following components (A), (B) and (C) or (D), or both (C) and (D):

(A) an aromatic amine color developing agent compound;

(B) a manganese salt and/or a cerium salt contained in the amount of 0.1 to 20 mg per liter of the developing solution;

(C) a diphosphonic acid sequestering agent and a magnesium salt and/or a lithium salt; and (D) at least one of a sequestering agent selected from the group consisting of the compounds represented by the formulas (I), (II), (III), (IV) and (V):

(I)

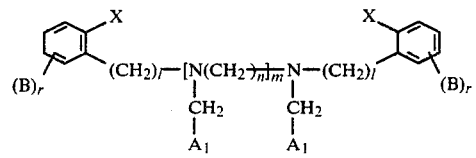

wherein $A_1$ represents a carboxylic acid group, a phosphoric acid group or a salt thereof; X represents a hydroxyl group or a salt thereof; B represents a halogen atom, a hydroxyl group, an alkyl group, a carboxylic acid group, a phosphoric acid group, or salts of a hydroxyl group, a carboxylic acid group or a phosphoric acid group; r and l each are integer of 0, 1 or 2; and n is an integer of 1 to 4; and m is an integer of 0 to 3, (II)

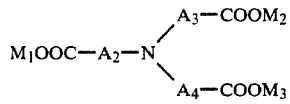

(III)

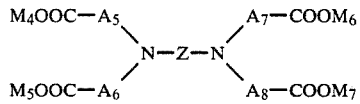

wherein $A_2$, $A_3$, $A_4$, $A_5$, $A_6$, $A_7$ and $A_8$ each represent an alkylene group; Z represents a divalent organic group; and $M_1$ to $M_7$ each represent a hydrogen atom or an alkaline metal atom,

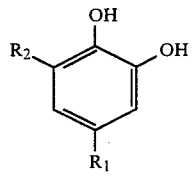

(IV)

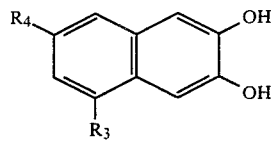

(V)

wherein $R_1$, $R_2$, $R_3$ and $R_4$ each represent a hydrogen atom, a halogen atom, a sulfonic acid group, an alkyl group having 1 to 7 carbon atoms, $-OR_5$, $-COOR_6$,

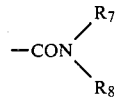

or a phenyl group; and $R_5$, $R_6$, $R_7$ and $R_8$ each represent a hydrogen atom or an alkyl group having 1 to 18 carbon atoms; provided that when $R_2$ represents —OH or a hydrogen atom, $R_1$ represents a halogen atom, a sulfonic acid group, an alkyl group having 1 to 7 carbon atoms, $-OR_5$, $-COOR_6$,

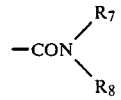

or a phenyl group.

2. A method for processing of the light-sensitive silver halide color photographic material according to claim 1, wherein said development process is carried out in the presence of a monochrome developing agent.

3. The method for processing of the light-sensitive silver halide color photographic material according to claim 1, wherein said aromatic primary amine color developing agent compound is a p-phenylenediamine color developing agent compound.

4. The method for processing of the light-sensitive silver halide color photographic material according to claim 1, wherein said aromatic primary amine color developing agent compound is contained in concentration of about 0.1 g to about 30 g per liter of the developing solution.

5. The method for processing of the light-sensitive silver halide color photographic material according to claim 1, wherein said manganese salt and cerium salt are compounds selected from the group consisting of manganese chloride, manganese sulfate, manganese sulfite, manganese bromide, manganese phosphate, manganese nitrate, potassium permanganate, manganese acetate, manganese oxalate, manganese citrate, (ethylenediaminetetraacetato)manganese salt, cerium sulfate, cerium nitrate, cerium chloride, cerium carbonate, cerium phosphate, cerium acetate, cerium citrate, cerium oxalate and (1,2-cyclohexanediaminetetraacetato)cerium salt.

6. The method for processing of the light-sensitive silver halide color photographic material according to claim 1, wherein component (C) is present and said diphosphonic acid sequestering agent is at least one compound selected from the group consisting of the compounds represented by the following formulas (VI) and (VII):

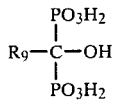

(VI)

wherein $R_9$ represents an alkyl group having 1 to 5 carbon atoms,

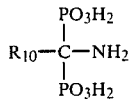

(VII)

wherein $R_{10}$ represents an alkyl group having 1 to 5 carbon atoms.

7. The method for processing of the light-sensitive silver halide color photographic material according to claim 1, wherein component (C) is present and said diphosphonic acid sequestering agent is contained in an amount of 0.01 g to 10 g per liter of the developing solution.

8. The method for processing of the light-sensitive silver halide color photographic material according to claim 1, wherein component (C) is present and said magnesium salt and lithium salt are compounds selected from the group consisting of magnesium chloride, magnesium sulfate, magnesium acetate, magnesium nitrate, magnesium bromide, magnesium phosphate, magnesium oxalate, magnesium citrate, lithium chloride, lithium sulfate, lithium nitrate, lithium phosphate and lithium acetate.

9. The method for processing of the light-sensitive silver halide color photographic material according to claim 1, wherein component (C) is present and said each of magnesium salt and lithium salt is contained in an amount of $\frac{1}{2}$ to 3 fold of moles based on the diphosphonic acid sequestering agent in the developing solution.

10. The method for processing of the light-sensitive silver halide color photographic material according to claim 1, wherein formula (III) of component (D) is present and Z in the formula (III) is an alkylene group, a cycloalkylene group or an alkylene group including an oxygen atom or nitrogen atom represented by the following formula (a) or (b):

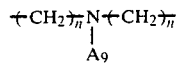

(a)

wherein n is an integer of 1 to 4; and $A_9$ represents a lower aliphatic carboxylic acid, $$-L-O-L-O-L- \quad (b)$$

wherein L represents an alkylene group.

11. The method for processing of the light-sensitive silver halide color photographic material according to claim 1, wherein formula (I) of component (D) is present and said sequestering agent represented by the formula (I) is contained in an amount of 3 mg to 1 g per liter of the developing solution.

12. The method for processing of the light-sensitive silver halide color photographic material according to claim 1, wherein formula (II) or (III) of component (D) is present and said each of sequestering agent represented by the formulas (II) or (II) is contained in an amount of 0.1 g to 5 g per liter of the developing solution.

13. The method for processing of the light-sensitive silver halide color photographic material according to claim 1, wherein formula (IV) or (V) of component (D) is present and said each of sequestering agent represented by the formulas (IV) or (V) is contained in an amount of 5 mg to 20 g per liter of the developing solution.

14. The method for processing of the light-sensitive silver halide color photographic mateiral according to claim 2, wherein said monochrome developing agent is a compound represented by the formula (VIII):

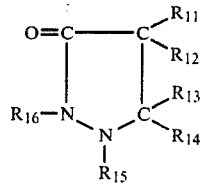

(VIII)

wherein $R_{11}$, $R_{12}$, $R_{13}$ and $R_{14}$ each represent a hydrogen atom, an alkyl group or an aryl group; $R_{15}$ represents an aryl group; and $R_{16}$ represents a hydrogen atom or an acetyl group.

15. The method for processing of the light-sensitive silver halide color photographic mateiral according to claim 2, wherein said monochrome developing agent is contained in concentration of about 3 mg to 10 g per liter of the developing agent.

* * * * *